United States Patent [19]

Bramley

[11] Patent Number: 4,878,752

[45] Date of Patent: Nov. 7, 1989

[54] SIGHTING SYSTEM

[75] Inventor: David F. Bramley, Surrey, United Kingdom

[73] Assignee: The Marconi Company Limited, England

[21] Appl. No.: 292,746

[22] Filed: Aug. 12, 1981

[30] Foreign Application Priority Data

Aug. 14, 1980 [GB] United Kingdom ..... 8026544

[51] Int. Cl.[4] ..... G01B 11/26

[52] U.S. Cl. ..... 356/152; 89/41.06; 89/41.05; 89/41.21; 89/41.19

[58] Field of Search ..... 89/41 AR, 41 E, 41 L, 89/41 AA, 41 TV, 41.06, 41.05, 41.21, 41.19; 250/342; 356/152

[56] References Cited

U.S. PATENT DOCUMENTS

| | | | |
|---|---|---|---|
| 3,059,338 | 10/1962 | Coeytarex | 89/41 E |
| 3,997,762 | 12/1976 | Ritchie et al. | 89/41 L |
| 4,145,952 | 3/1979 | Tye | 89/41 E |
| 4,312,262 | 1/1982 | Tye | 89/41 AE |
| 4,404,890 | 9/1983 | McAlpine | 89/41 F |
| 4,422,758 | 12/1983 | Godfrey et al. | 356/152 |

FOREIGN PATENT DOCUMENTS

| | | | |
|---|---|---|---|
| 2098706 | 11/1982 | United Kingdom | 89/41 R |

*Primary Examiner*—Nelson Moskowitz

*Attorney, Agent, or Firm*—Kirschstein, Ottinger, Israel & Schiffmiller

[57] ABSTRACT

A gun sighting system in which a daylight (visual) sight and a thermal imaging (TI) night sight are mounted on the gun breech. The TI field of view is superimposed on the visual field of view, necessitating accurate alignment between their lines of sight and the gun muzzle boresight. Adjustment of the visual sight causes separation of the visual and TI displayed images which is indeterminate in the absence of distinct target features. In accordance with the invention a visual reference mark is injected on to the field of view, which reference mark is locked to the target scene. Separation of the visual and TI scenes causes corresponding separation of the reference mark and TI sight line marker thus permitting adjustment of the TI field of view to remove this separation and align the visual and TI scenes.

7 Claims, 2 Drawing Sheets

SIGHTING SYSTEM

This invention relates to a sighting system particularly, but not exclusively, for a weapon aiming system.

A problem occurs when two or more devices have to maintain line of sight in precise alignment each with the other, particularly when these devices are required to maintain their alignment throughout the azimuth or elevation movements of the system. The problem is also increased by effective shift of the line of sight due to instabilities in the scanning and/or relay and/or display elements of any one or more parts of the system.

An example of this problem is the need to maintain precise alignment between a gun muzzle, its associated visual sight for a further sight, e.g. a night sight, which may employ a scene scanning and display system. Ideally, movement of the gun should be precisely followed by both sighting systems, but the existence of movement relaying mechanisms introduces errors in the accuracy of the resulting alignment, and further errors may occur due to the shift of the point of reference of the scanning system or the display system.

In a previously proposed system for checking and maintaining alignment between a primary sight (a visual or daylight sight) and a gun muzzle, a reference system is employed in which a mirror is mounted at the front of the muzzle and a projector at the back. The visual sight is also mounted to move with the muzzle and is initially aligned with the muzzle so that the boresight of the muzzle and the line of sight of the visual sight intersect at some standard target distance. In this condition of initial alignment, the mirror and/or projector are adjusted so that the projector source image appears in the visual sight field of view in alignment with the muzzle-boresight graticule mark which indicates the line of sight of the visual sight.

The visual sight will normally be to one side of the muzzle and the reflected reference beam has therefore to be deflected by a prism into the line of sight of the visual sight.

Operational conditions, heating of the muzzle, imperfect relaying of muzzle movement to the visual sight (where the sight is not directly mounted on the muzzle) etc. may cause the initial alignment of the muzzle boresight and the visual line of sight to drift. Such drift can be checked by operating the projector and noting the position of the muzzle reference (reflected) image in relation to the muzzle boresight mark in the field of view. Any discrepancy can be corrected by adjusting the visual sight to bring the boresight mark into coincidence with the muzzle reference image.

The problem previously mentioned arises when a second sight, e.g. an infra-red thermal-imaging sight, is employed for night-time use. The visual sight can be readily adjusted but it may be impractical or otherwise undesirable to use the same, or duplicated, mirror/projector reference system for the thermal imaging (TI) sight.

The TI field of view may be presented on a C.R.T. display and projected on to, i.e. superimposed on, the visual sight display so they have a common field of view, initially at least. If, therefore, there happens to be a distinct target or prominent object in a suitable position, the TI sight can be manually adjusted until the visual and TI images of this target are superimposed so bringing the lines of sight of the visual and TI sights into alignment.

However, such a convenient target reference cannot be relied upon and the difficulty arises of determining what correction has been made to the visual sight and transferring this to the TI sight. The two could be slaved together, mechanically or electrically, with a suitable coupling function, but this may not be practical in view of the coupling tolerances and the different corrections that are needed for the two sights as a result of their different positions.

An object of the present invention is therefore to provide a simple method of aligning two sights after one has been re-set.

According to the present invention, a sighting system comprises first and second optical sights mounted so as to have substantially the same field of view, the field of view of the second optical sight being superimposed on that of the first and each being individually controllable within a limited angle, the first optical sight having a first line of sight marker which is movable with the field of view and the second optical sight having a second line of sight marker which is located with reference to the scene viewed, the system further including means for injecting a reference mark into the field of view of the first optical sight which reference mark can be aligned with the projected view of the second line of sight marker and is otherwise located with respect to the scene viewed, the arrangement being such that alignment of the two fields of view is effected by control of the field of view of the second optical sight to maintain the relationship between the reference mark and said second line of sight marker.

In use with an artillery gun, the first optical sight may be a visual sight adapted to be adjusted for alignment with the gun muzzle and the second optical sight may be an infra-red sight.

There may be included a muzzle reference system having a projector source mounted at the rear of the gun, a mirror mounted with reference to the mouth of the muzzle to reflect an image of the projector source into the superimposed fields of view in coincidence with a boresight mark constituting said first line of sight marker, separation of the reflected image and the boresight mark indicating a required correction of the line of sight of the visual sight and a corresponding correction of the line of sight of the infra-red sight by bringing said second line of sight marker back into alignment with said reference mark when they are relatively displaced on re-alignment of said reflected image and said boresight mark.

A sighting system for an artillery gun and in accordance with the invention will now be described, by way of example, with reference to the accompanying drawings, of which:

Figure 3:
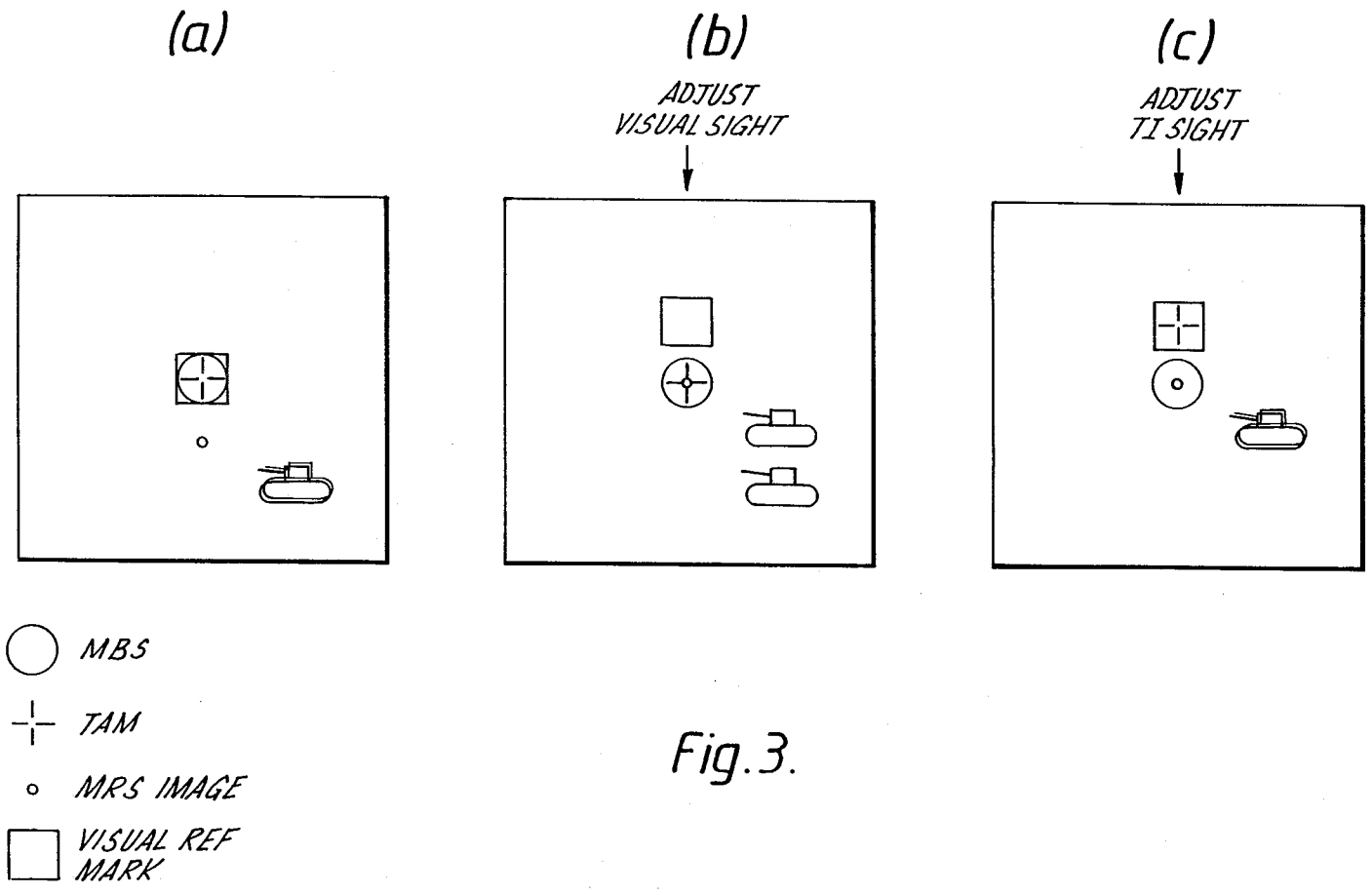

and FIG. 3 is a diagram of the operator's view through the sight in a sight alignment procedure.

Figure 1:
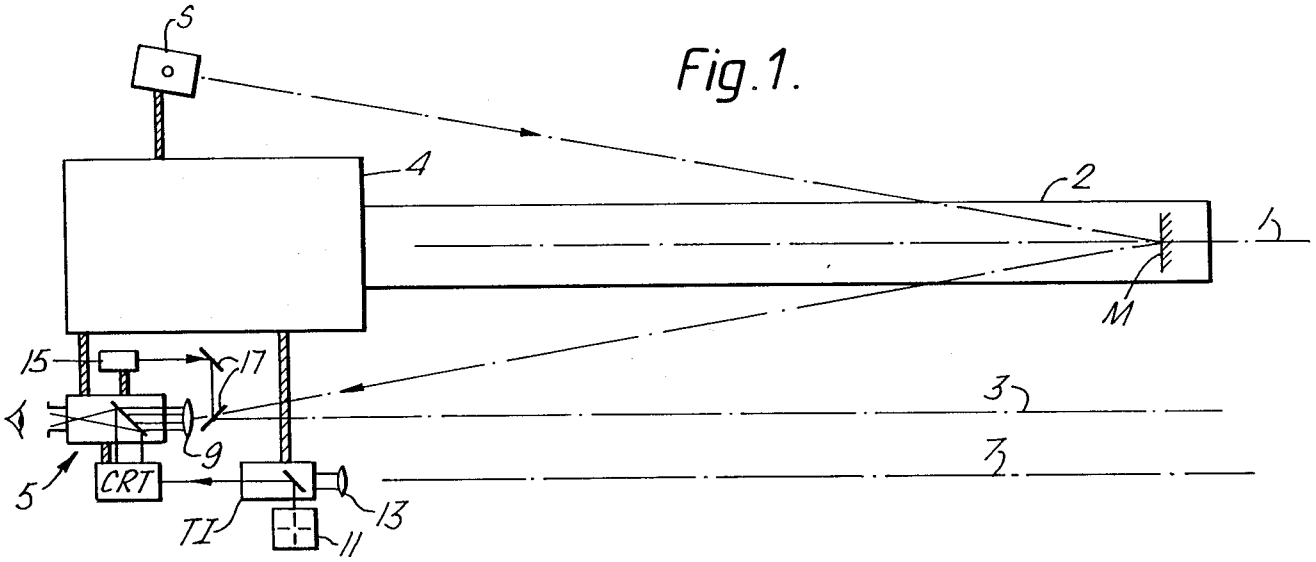
FIG. 1 is a diagrammatic view of a gun incorporating the sighting system.
Figure 2:
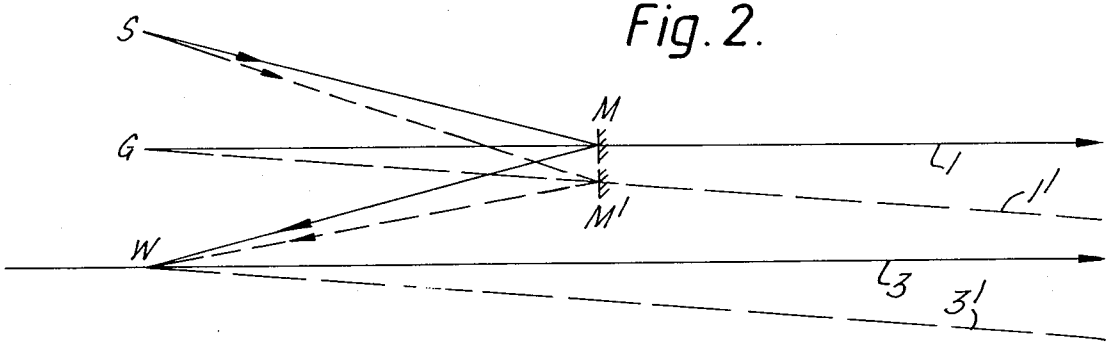
FIG. 2 is a diagram illustrating the operation of a muzzle reference system.

Referring to FIGS. 1 and 2, the gun muzzle 2 has an initial boresight 1. The visual sight 5 has a wedge prism W (shown in FIG. 2 only) ahead of its object lens, the prism W being movable transversely in and out of position for setting up purposes. The line of sight 3 of the visual sight is initially directed to intersect the boresight 1 at the standard target distance, which may typically be 1000 meters.

A mirror M is mounted on the muzzle 2 at the front end and a projector S is mounted on the gun at the breech end 4. The mirror M and projector S are arranged so that, when the boresight 1 and line of sight 3 are aligned, a spot of light, the reference image, is reflected on to the visual sight 5 by way of the prism W and so as to coincide with a boresight mark (MBS) which indicates the line of sight 3 of the visual sight. This arrangement constitutes the muzzle reference system.

Referring particularly to FIG. 2, if the muzzle moves in operation, such that the mirror M moves to a position M', the boresight line will now be 1' and will not be aligned with the visual line of sight 3. This error is corrected by a screw adjustment which tilts the object lens 9 of the visual sight in azimuth and/or elevation selectively, until the spot of light, the muzzle reference image, is re-aligned with the muzzle boresight mark. The visual line of sight 3' is then again correctly aligned with the muzzle boresight.

The muzzle boresight mark indicates both the line of sight of the visual sight 5 and also the line of sight of a laser incorporated in the sight for rangefinding purposes. The muzzle boresight mark must therefore be used for target alignment, rather than, say, the muzzle reference image, which does indicate the muzzle boresight.

A thermal imaging sight TI, sensitive to infra-red radiation, is mounted adjacent the visual sight 5 so as to have substantially the same field of view. The shaded bars between the various constituents indicate rigid connections. The output of the TI sight is displayed on a C.R.T in known manner and the displayed infra-red scene is projected into the field of view of the visual sight by a prism reflector. The two fields of view are thus superimposed and must of course be accurately aligned if the gunner/operator is not to be confused.

The line of sight of the TI sight is indicated by a thermal aiming mark (TAM) illustrated as a crosswire. This second line of sight marker is produced by a projector 11 which has a 'crosswire' slide the image of which is projected into the TI object lens 13 by way of a prism reflector as for the visual sight.

Control of the field of view of the TI sight is effected electronically, by shifting the raster of the C.R.T. display in each of two directions by a controllable D.C. bias imposed on the raster signals. A different portion of the raster is thus projected into the visual sight as the bias is adjusted. Clearly, the TI line of sight marker will be locked to the infra-red scene as the raster, and thus the TI field of view projected into the visual sight, is shifted. Because the TI sight field of view is controlled so far back in the TI imaging process, the TI aiming mark can be introduced into the TI sight even behind the object lens 13, i.e. as indicated in FIG. 1.

The TI sight is initially set up so that its line of sight 7, as indicated by its marker, also intersects the muzzle boresight line 1 at the standard target distance.

Referring now to FIG. 3, each of FIG. 3(*a*), (*b*) and (*c*) shows the field of view common to the visual and TI sights, i.e. as seen by the gunner. The basic marker of the visual sight is the muzzle boresight mark designated MBS in the legend. This indicates the visual line of sight (and the laser axis) and is required to be kept aligned with the muzzle boresight. The latter is indicated by the reflected spot designated "MRS image" in the legend. The line of sight of the TI sight is indicated by the injected thermal aiming mark, designated TAM in the legend.

The remaining symbol in FIG. 3 is the visual reference mark, not yet mentioned.

The visual reference mark, shown as a square in FIG. 3, is produced by a projector 15 in FIG. 1, the image of the square being projected into the (adjustable) object lens of the visual sight by way of reflecting prisms 17. Since the source of the reference mark is external to the object lens, adjustment of the latter will cause the reference mark to move as one with the visual scene. The projector 15 is normally inoperative, being switched on during the sight alignment procedure.

In FIG. 3(*a*) the operator sees two superimposed images of a target tank, a visual image 17 derived by the visual sight and an infra-red image 19 derived by the TI sight (the latter is shown shaded). He also sees the MBS mark aligned with the TAM mark but both out of alignment with the spot 11 of the MRS image. The particular displacement shown would indicate that the muzzle had dropped since setting up, as a result of thermal changes after firing, perhaps.

The operator then adjusts the visual sight (by controlling the tilt of the object lens 9) until the MBS mark is brought into alignment again with the spot 11 of the MRS image. In doing so, the visual scene, including the target image 17, moves with the MRS image and the visual and TI scenes become separated, as indicated by the separation of the targets 7 and 9.

If a distinguishable target, such as the tank shown, were present, the TI sight could then be re-aligned with the visual sight by manual adjustment of the TI sight line until the separated images are again coincident.

In the absence of such a distinctive target however, the problem of aligning the TI sight remains. In the presently described arrangement the problem is solved by injecting the visual reference mark, shown as a square symbol, into the visual sight, and in such manner that the visual reference mark moves with the visual scene as explained above. When the visual sight is corrected therefore, as shown in FIG. 3(*b*) the visual reference mark, which was previously in alignment with the muzzle boresight mark MBS, is displaced from it by the same amount as was necessary to bring the MRS spot and MBS into coincidence. There is therefore displayed a measure of the required displacement of the TI line of sight irrespective of the presence of any distinguishable target. The TI sight is then adjusted as shown in FIG. 3(*c*) until the thermal aiming mark TAM is again in coincidence with the injected visual reference mark. The two images of the target will then be found to have coincided.

I claim:

1. A sighting system comprising:

first and second optical sights mounted so as to have substantially the same field of view, means for superimposing the field of view of the second optical sight on the field of view of the first optical sight, means for controlling the field of view of each of the first and second optical sights within a limited angle, means for providing a first line of sight marker in said first optical sight which marker is movable with the field of view, means for providing a second line of sight marker in said second optical sight which marker is located with reference to the scene viewed, and means for injecting a reference mark into the field of view of the first optical sight which reference mark can be aligned with the projected view of said second line of sight marker and is otherwise located with respect to the scene viewed, alignment of the field of view of the second optical sight with the field of view of the first optical sight being effected by control of the field of view of the second optical sight to maintain the relationship between said reference mark and said second line of sight marker.

2. A sighting system according to claim 1, for use with an artillery gun, said first optical sight being a visual sight adapted to be adjusted for alignment with the gun muzzle and said second optical sight being an infra-red sight.

3. A sighting system according to claim 2, comprising a muzzle reference system having a projector source mounted at the rear of the gun, a mirror mounted with reference to the mouth of the muzzle to reflect an image of the projector source into the superimposed fields of view in coincidence with a boresight mark constituting said first line of sight marker, separation of the reflected image and the boresight mark indicating a required correction of the line of sight of the visual sight and a corresponding correction of the line of sight of the infra-red sight by bringing said second line of sight marker back into alignment with said reference mark when they are relatively displaced on re-alignment of said reflected image and said boresight mark.

4. A sighting system according to claim 3, wherein said second line of sight marker is provided by a projector source incorporated in said infra-red sight, the image of the projector source being projected into the field of view of the sight.

5. A sighting system according to claim 4, wherein said reference mark is provided by a projector source mounted on the gun and optical means to inject the projected image into the visual sight.

6. A sighting system according to any one of claims 1 to 5, wherein control of the field of view of said first optical sight is effected by tilting the object lens of that sight.

7. A sighting system according to any one of claims 1 to 5, wherein the field of view of said second optical sight is presented by a C.R.T. display, an image of which is projected into the visual sight, and wherein control of the field of view of said second optical sight is effected by electronic control of the C.R.T. raster position.

* * * * *